US006405015B1

(12) United States Patent
Suzuki

(10) Patent No.: US 6,405,015 B1
(45) Date of Patent: Jun. 11, 2002

(54) CLEANING MEMBER CLEANING DEVICE AND IMAGE FORMING APPARATUS AND PROCESS CARTRIDGE TO WHICH THIS CLEANING DEVICE IS APPLIED

(75) Inventor: Jun Suzuki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/375,997

(22) Filed: Aug. 19, 1999

(30) Foreign Application Priority Data

Aug. 31, 1998 (JP) ..... 10-244597

(51) Int. Cl.[7] ..... G03G 21/00
(52) U.S. Cl. ..... 399/350
(58) Field of Search ..... 399/350; 430/109; 15/256.5, 256.51

(56) References Cited

U.S. PATENT DOCUMENTS

| | | | | |
|---|---|---|---|---|
| 3,936,183 A | * | 2/1976 | Sadamatsu | 399/350 |
| 5,646,718 A | | 7/1997 | Suwa et al. | 399/350 |
| 5,752,151 A | * | 5/1998 | Inoue et al. | 399/350 |
| 5,765,088 A | * | 6/1998 | Nakayama et al. | 399/350 |
| 5,976,750 A | * | 11/1999 | Hagi et al. | 430/110 |
| 5,995,785 A | | 11/1999 | Kato et al. | 399/127 |

FOREIGN PATENT DOCUMENTS

| | | | |
|---|---|---|---|
| EP | 0 384 354 | | 8/1990 |
| JP | 1-105983 | | 4/1989 |
| JP | 5-313425 | | 11/1993 |
| JP | 08-123273 | * | 5/1996 |
| JP | 08-234639 | * | 9/1996 |
| JP | 08-328438 | * | 12/1996 |
| JP | 09-281865 | * | 10/1997 |
| JP | 10-214013 | | 8/1998 |

* cited by examiner

*Primary Examiner*—Robert Beatty
(74) *Attorney, Agent, or Firm*—Fitzpatrick, Cella, Harper & Scinto

(57) ABSTRACT

A cleaning member for rubbing and removing toner having a shape coefficient SF1 of 10 to 150 remaining on a member to be cleaned in an electrophotographic apparatus. The cleaning member has an elastic blade, which has a 200 kg/cm$^2$ or greater value or breaks a tensile strength of 300% elongation and a hardness of (JIS A) 60° to 80°. A blade supporting member causes the elastic blade to abut in a counter direction against the photosensitive member, which moves endlessly to rub and remove toner remaining on the photosensitive member after a transfer process, wherein the elastic blade abuts against a surface of a photosensitive member at an abutment pressure of a 55 gf/cm or greater without an inroad amount of the elastic blade into said photosensitive member exceeding 1.6 mm.

9 Claims, 8 Drawing Sheets

$$SF1 = \frac{(MXLNG)^2}{AREA} \times \frac{\pi}{4} \times 100$$

$$SF2 = \frac{(PERI)^2}{AREA} \times \frac{1}{4\pi} \times 100$$

CLEANING MEMBER CLEANING DEVICE AND IMAGE FORMING APPARATUS AND PROCESS CARTRIDGE TO WHICH THIS CLEANING DEVICE IS APPLIED

BACKGROUND OF THE INVENTION

1. Field of the Invention

The present invention relates to a cleaning device including an elastic blade for use in an image forming apparatus into which an electrophotographic process is adopted, and an image forming apparatus and a process cartridge on which the cleaning device is mounted.

2. Related Background Art

Conventionally from a viewpoint of a simple constitution and a reasonable price as a cleaning means included in an image forming apparatus into which an electrophotographic process is adopted, there has been prevalently used what is called a blade cleaning method with an elastic blade as shown in FIG. 10. In FIG. 10, a photosensitive drum 101 is used as an image bearing member driven to rotate in a direction indicated by an arrow, and a cleaning means 102 comprises a waste toner collecting container 103, a supporting member 104 attached to the waste toner collecting container 103, an elastic blade 105 supported by the supporting member 104, and a toner scavenging sheet 106. The elastic blade 105, which is made of urethane rubber, abuts against a surface of the photosensitive drum 101 what is called in the counter direction. In other words, at least a distal end of the elastic blade 105 supported by the supporting member 104 abuts against the surface of the photosensitive drum 101 and at least a part of the abutment surface of the elastic blade 105 against the surface of the photosensitive drum 101 is gradually spaced from the surface of the photosensitive drum 101 in a downstream direction of a rotary direction of the photosensitive drum 101.

As a demand for color image forming apparatuses is increased in recent years, however, more stable toner is required, and therefore there is a tendency to adopt almost spherical toner capable of having more uniform charging characteristics as an expedient.

On the other hand, it is known that this type of substantially spherical toner is very hard to be removed by being scraped off from the surface of the photosensitive drum 101 by the elastic blade 105 as cleaning means. It is deemed to be why the elastic blade 105 abutting against the surface of the photosensitive drum 101 chatters when the photosensitive drum 101 is driven to rotate and the substantially spherical toner easily passes through a slight gap between the surface of the photosensitive drum 101 and the elastic blade 105 generated at that time.

Additionally, in general, toner has on its outer surface additive particles each having smaller particle diameter than that of the toner for the main purpose of stabilizing toner by increasing its charges. As the outer additive, powder of the silica group or the like is used, for example, and it is attached on the surface of each toner particle as if each toner particle is sprinkled with the powder.

In the substantially spherical toner, however, an adhesive force between the toner and its outer additive tends to be smaller than that between aspherical toner and its outer additive. If this type of toner is used for forming an image, the outer additive is easily liberated from the surface of respective toner particles gradually as the number of the images formed sheets is increased.

In addition, since the outer additive made of particles each having a smaller particle diameter in comparison with the toner as described above, the elastic blade 105 abutting against the surface of the photosensitive drum 101 chatters when the photosensitive drum 101 is driven to rotate, and therefore there is a tendency that the additive is relatively easy to pass through a slight gap between the surface of the photosensitive drum 101 and the elastic blade 105 generated at that time.

To solve this problem, in an image forming apparatus for performing an image forming operation by using almost spherical toner, there is disclosed means for preventing a cleaning failure when removing transfer residual toner on the surface of the photosensitive drum 101 after a transfer process and its outer additive from the surface of the photosensitive drum by causing the elastic blade 105 to abut against the surface of the image bearing member 101 at an abutment pressure with a linear load of 55 gf/cm or greater and 105 gf/cm or smaller (Japanese Patent Application Laid-Open No. 10214013).

The greater the abutment pressure of the elastic blade 105 against the photosensitive drum 101 is, however, there more easily occurs an undesirable phenomenon called "fusion bond" in which outer additive or the like is fixed on the surface of the photosensitive drum 101 caused by the outer additive passing through the abutment portion between the photosensitive drum 101 and the elastic blade 105.

SUMMARY OF THE INVENTION

It is an object of the present invention to provide an image forming apparatus in which charging means, exposure means, developing means, and transfer means are arranged in this order around a rotatable image bearing member, for visualizing an electrostatic latent image formed on a surface of the image bearing member by substantially spherical toner, electrostatically transferring it onto a surface to be transferred in a transfer position, and preventing a cleaning failure by using a cleaning device mounted for a purpose of removing residual substantially spherical toner remaining on the surface of the image bearing member from the surface of the image bearing member so as to suppress a fusion bond of toner and outer additive onto the image bearing member.

It is another object of the present invention to provide a cleaning device according to the above for suppressing an inroad amount $\delta$ to the image bearing member of an elastic blade required for causing the elastic blade to abut against the image bearing member at a high abutment pressure to prevent the elastic blade from abutting against the image bearing member at a portion other than the edge (side abutment) of the elastic blade which may occur at an extreme increase of the inroad amount $\delta$, so as to prevent a cleaning failure.

It is still another object of the present invention to provide a cleaning device according to the above in which it is hard to generate a gap between the surface of the image bearing member and the elastic blade when the elastic blade abutting against the surface of the image bearing member chatters thereby the substantially spherical toner and the outer additive are prevented from passing through the gap in order to enhance its cleaning property.

It is a further object of the present invention to provide an image forming apparatus for forming an image by using substantially spherical toner in which a cleaning failure is prevented to suppress a fusion bond of the toner and its outer additive onto an image bearing member so as to obtain a high-quality output image for a long period.

It is a still further object of the present invention to provide an image forming apparatus in which a part of a mechanism required for forming an image is integrated with being detachably mountable to a main body of the image forming apparatus, including at least an image bearing member and the above cleaning device, in order to facilitate maintenance of the image forming apparatus and replacement of consumable components.

According to one aspect, the present invention which achieves these objects relates to a cleaning member for use in a cleaning device applied to an electrophotographic apparatus comprising an elastic blade which has a value of 200 kgf/cm$^2$ or greater or breaks a tensile strength of 300% elongation to rub and remove toner having a shape coefficient SF1 of 100 to 150 remaining in a cleaned member in a main body of the electrophotographic apparatus and a blade supporting member for supporting this elastic blade.

According to another aspect, the present invention which achieves these objects relates to a cleaning device to which the cleaning member is applied, an image forming apparatus having this cleaning device, or a process cartridge detachably mountable to a main body of the image forming apparatus.

DETAILED DESCRIPTION OF THE PREFERRED EMBODIMENTS

First Embodiment

An embodiment according to the present invention will be described below.

Figure 1:
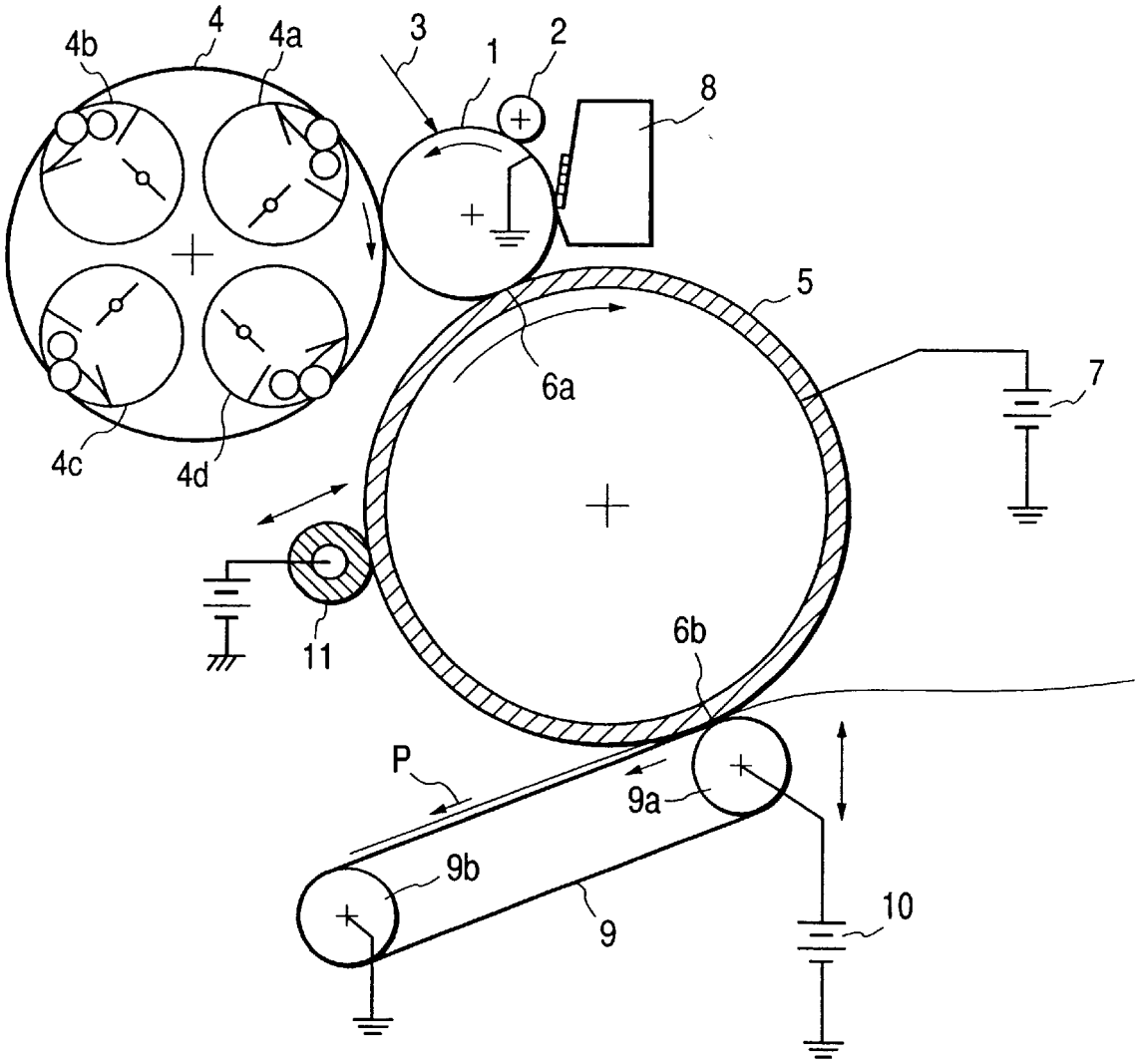
FIG. 1 is a configuration diagram of assistance in explaining an image forming apparatus on which a cleaning device is mounted according to a first embodiment of the present invention.

Referring to FIG. 1, there is shown a configuration diagram for assistance in explaining an image forming apparatus (specifically, a color image forming apparatus) according to the present invention.

In FIG. 1, a photosensitive drum 1 is used as a first image bearing member, in which OPC or other photosensitive material is formed on an outer peripheral surface of an aluminum or other cylindrical substrate, and its detailed configuration will be described later.

The photosensitive drum 1 is driven to rotate at 120 mm/sec of a circumferential velocity in a direction indicated by an arrow, and first its surface is uniformly charged at −700 V as dark section potential VD by a charging roller 2 used as a contact charging means. Next, a laser beam 3 controlled ON and OFF depending upon first image information is applied for scanning and exposure, by which a first electrostatic latent image is formed at −100 V as light section potential VL.

The electrostatic latent image formed in this manner is developed so as to be visualized by a developing device 4. The developing device 4 comprises a first developing device 4*a* in which yellow toner is contained as toner of a first color, a second developing device 4*b* in which magenta toner is contained as toner of a second color, a third developing device 4*c* in which cyan toner is contained as toner of a third color, and a fourth developing device 4*d* in which black toner is contained as toner of a fourth color with being integrated. First, the first electrostatic latent image is developed to be visualized by the first developing device 4*a* in which yellow toner is contained as toner of the first color. As a developing method, a jumping developing method, a two-component developing method, or a FEED developing method is used, in which an image exposure is often combined with a reversal development.

The image visualized with the toner of the first color is electrostatically transferred onto a surface of an intermediate transfer member 5 (primary transfer) in a first transfer position 6*a* opposite to the intermediate transfer member 5 as a second image bearing member driven to rotate. The intermediate transfer member 5, which has a perimeter a little longer than a length of a transfer material, with being contacted with a predetermined pushing pressure against the photosensitive drum 1, is driven to rotate in a forward direction to a rotary direction of the photosensitive drum 1 at a circumferential speed substantially equal to that of the photosensitive drum. A toner image formed on the surface of the photosensitive drum 1 as described above is electrostatically transferred (primary transfer) onto the surface of the intermediate transfer member 5 by an application of a voltage (primary transfer bias) having a polarity opposite to a charging polarity of the toner to the intermediate transfer member 5 from a high-voltage power supply 7.

A small amount of toner remaining on the surface of the photosensitive drum 1 after a completion of the primary transfer is removed by a cleaning device 8.

Subsequently the process in the above is reiterated three times, that is, a second color toner image developed with magenta toner, a third color toner image developed with cyan toner, and a fourth color toner image developed with black toner are sequentially transferred onto the surface of the intermediate transfer member 5 and superposed on top of each other.

Afterward, a transfer belt 9 which has been spaced from the surface of the intermediate transfer member 5 is pressed to be put into contact with the surface of the intermediate transfer member 5 with a predetermined pushing pressure so as to be driven to rotate. The transfer belt 9 is supported by a bias roller 9*a* and a tension roller 9*b*, and a voltage (secondary transfer bias) having a polarity opposite to the charging polarity of the toner is applied to the bias roller 9*a* from a high-voltage power supply 10, by which toner images formed on the surface of the intermediate transfer member 5 are transferred in unison (secondary transfer) onto a surface of a transfer material P conveyed at a predetermined timing to a second transfer position 6*b*, and the transfer material P is conveyed to a fixing device which is not shown in order to fix the image as a permanent image and is discharged outside the apparatus.

A small amount of toner remaining on the surface of the intermediate transfer member 5 after a completion of the secondary transfer is removed by the cleaning device 11 which is brought into an abutment state against the surface of the intermediate transfer member 5 at a predetermined timing.

Subsequently, the photosensitive drum used in this embodiment will be described below.

Figure 2:
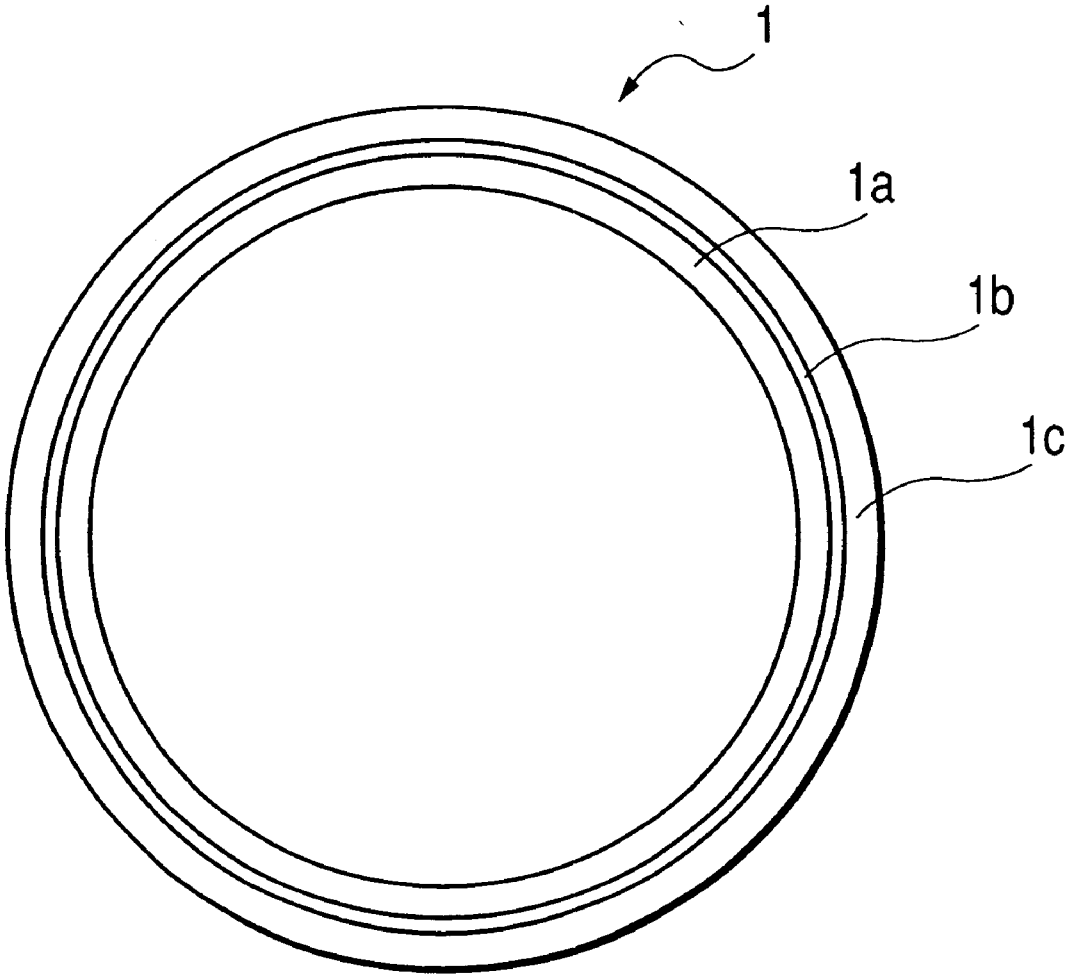
FIG. 2 is a schematic sectional view of a photosensitive drum according to the first embodiment of the present invention.

For the photosensitive drum used in this embodiment, a charge generation layer 1*b* having a thickness of 0.2 μm made of phthalocyanine chemical compound is formed on an aluminum core metal 1*a* having an outer diameter of about 60 mm as shown in FIG. 2, and for a further upper layer, is used what is called an organic photoconductor which forms a charge transport layer Ic having a thickness of 20 μm made of polycarbonate as binder in which hydrazone chemical compound is dispersed.

As a result of measuring a contact angle and a slip property of the surface of the photosensitive drum 1 to water, the contact angle is 85° and the slip property is unmeasurable due to no slippage.

The "slip property" in the above is measured by a slip property tester manufactured by Heidon Co. and a slip property of a measured object is has by a ratio relative to polyethylene terephthalate (PET) with being referenced to a slip property of PET as 1, where a smaller value of the ratio indicates a superior slip property.

Next, the toner used in this embodiment will be described below.

The toner used in this embodiment, which includes low softening point material of 5 to 30 wt. %, is non-magnetic monocomponent toner having the shape coefficient SF1 of 100 to 150 and the shape coefficient SF2 of 100 to 140, being composed of substantial spherical particles each having a particle diameter of 5 to 7 μm.

Figure 3:
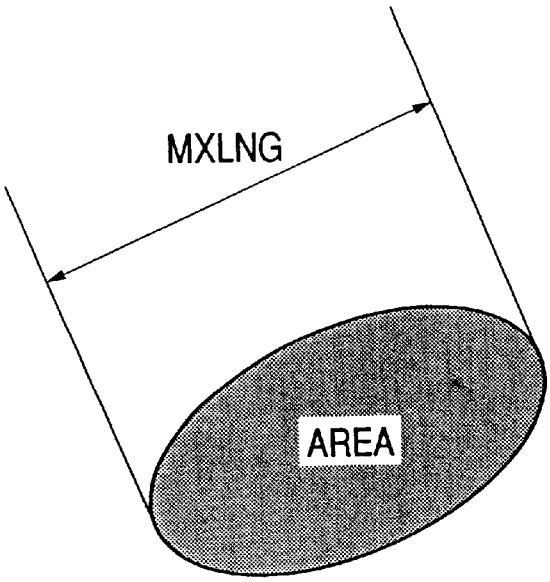
FIG. 3 is a diagram for assistance in explaining a shape coefficient SF1.

The "shape coefficient SF1" in the above is a value indicating a roundness ratio of a shape of the spherical material as shown in FIG. 3 and it has a value obtained by dividing the square of the maximum length MXLNG of an oval figure formed by a projection of the spherical material on a two-dimensional plane by a graphical area AREA and then multiplying the value by 100π/4.

In other words, the value is defined by the following formula:

$$SF1=\{(MXLNG)^2/AREA\}\times(100\pi/4)$$

Figure 4:
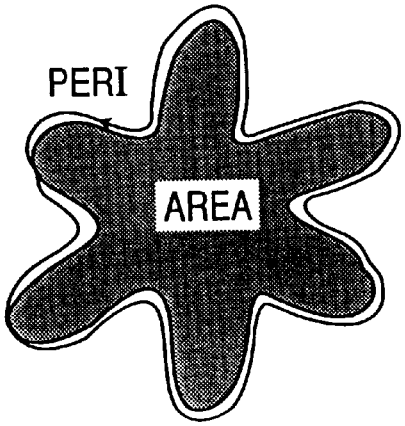
FIG. 4 is a diagram for assistance in explaining a shape coefficient SF2.

The "shape coefficient SF2" is, as shown in FIG. 4, a numerical value has an unevenness ratio of a shape of the material and it is indicated by a value obtained by dividing a perimeter PERI of a figure formed by a projection of the material on a two-dimensional plane by a graphical area AREA and then multiplying the value by 100/4π.

In other words, the value is defined by the following formula:

$$SF2=\{(PERI)^2/AREA\}\times(100/4\pi)$$

For the SF1 and SF2 in this embodiment, a toner image is sampled 100 times at random by using an FE-SEM (S-800) manufactured by Hitachi, Ltd. and the image information is introduced to an image analytic device (Luzex3) manufactured by Nicolet Japan Corporation via an interface for analysis, by which the value are obtained as a calculation of the above formulas.

Figure 5:
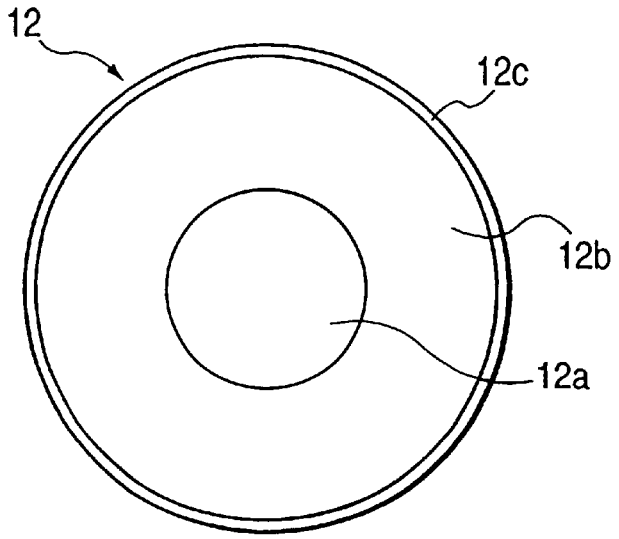
FIG. 5 is a schematic sectional view of toner according to the present invention.

A schematic configuration diagram of the toner 12 is shown in FIG. 5. This type of toner has particles which are substantially spherical due to its manufacturing method. In this embodiment, is used toner which comprises a core 12*a* made of ester wax included inside, a resin layer 12*b* made of styrene-butyl acrylate, and a surface layer 12*c* made of styrene-polyester. Its specific gravity is approx. 1.05.

As described above, an offset prevention effect in a fixing process is obtained by containing the wax in the core 12*a*, a charging efficiency is increased by providing the surface layer 12*c* with the resin layer, and further −20 μC/g of triboelectricity (Q/M) of the above toner is obtained by externally adding oil processed silica for stabilization of the triboelectricity.

Next, a cleaning device 8 including the elastic blade used in this embodiment will be described below by using FIG. 6.

Figure 6:
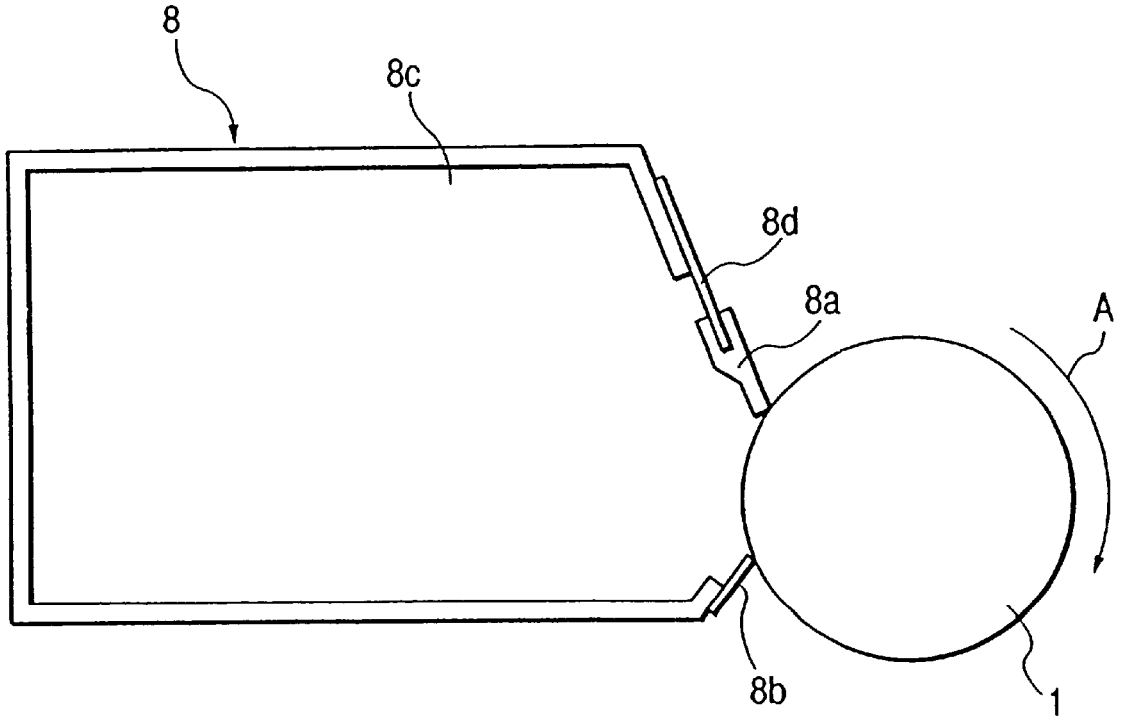
FIG. 6 is a schematic configuration diagram of a cleaning device according to the present invention.

In FIG. 6, there are shown a cleaning blade 8*a*, a toner scavenging sheet 8*b*, and a waste toner collecting container 8*c*.

As previously described, a small amount of toner remaining on the surface of the photosensitive drum 1 after a completion of the primary transfer is removed from the photosensitive drum 1 by the cleaning blade 8*a* which is a component of the cleaning device 8 and stored in the waste toner collecting container 8*c* without scattering to the outside of the cleaning device 8 by using the toner scavenging sheet 8*b*.

On the other hand, the cleaning blade 8*a* is made of polyurethane rubber integrally held at a distal end of sheet metal 8*d*, while abutting against the photosensitive drum 1 on conditions of a predetermined inroad amount δ and a preset angle θ.

Figure 11:
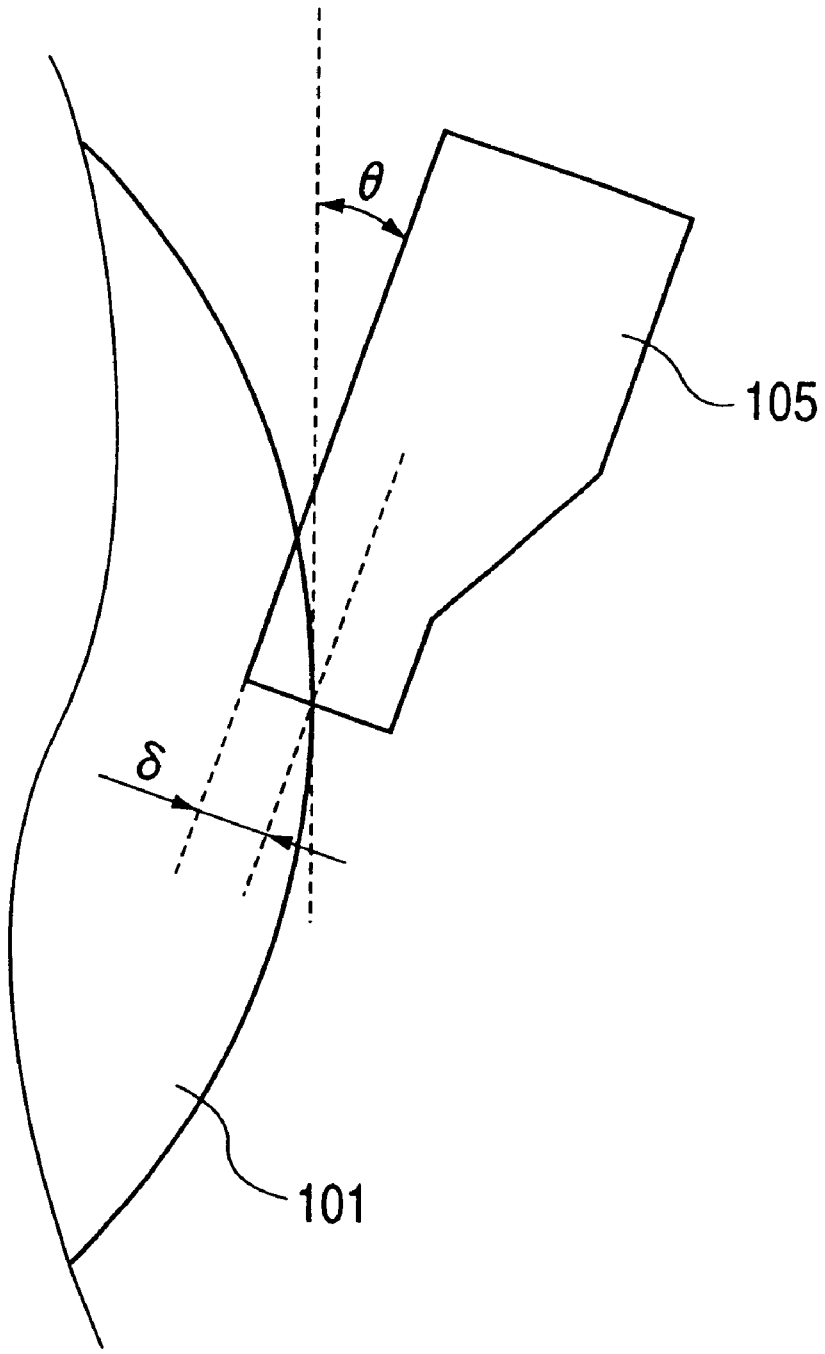
FIG. 11 is a diagram for assistance in explaining an inroad amount ($\delta$) and a preset angle ($\theta$) of the cleaning blade to an image bearing member.

As shown in FIG. 11, the "inroad amount δ" is a virtual amount of a distal end of the elastic blade 105 inroading into the photosensitive drum 101 as an image bearing member without being deformed, and the "preset angle θ" is an angle made by a tangent at a point where the distal end of the elastic blade meets with the image bearing member and the elastic blade in the above virtual state.

When the inroad amount δ is increased extremely, the elastic blade may abut against a portion other than the edge of the image bearing member (side abutment). In a second embodiment of the present invention according to this application, however, the inroad amount δ of the elastic blade toward the image bearing member can be suppressed to a small amount and therefore the side abutment can be prevented so as to prevent a cleaning failure from being caused by this.

Figure 7:
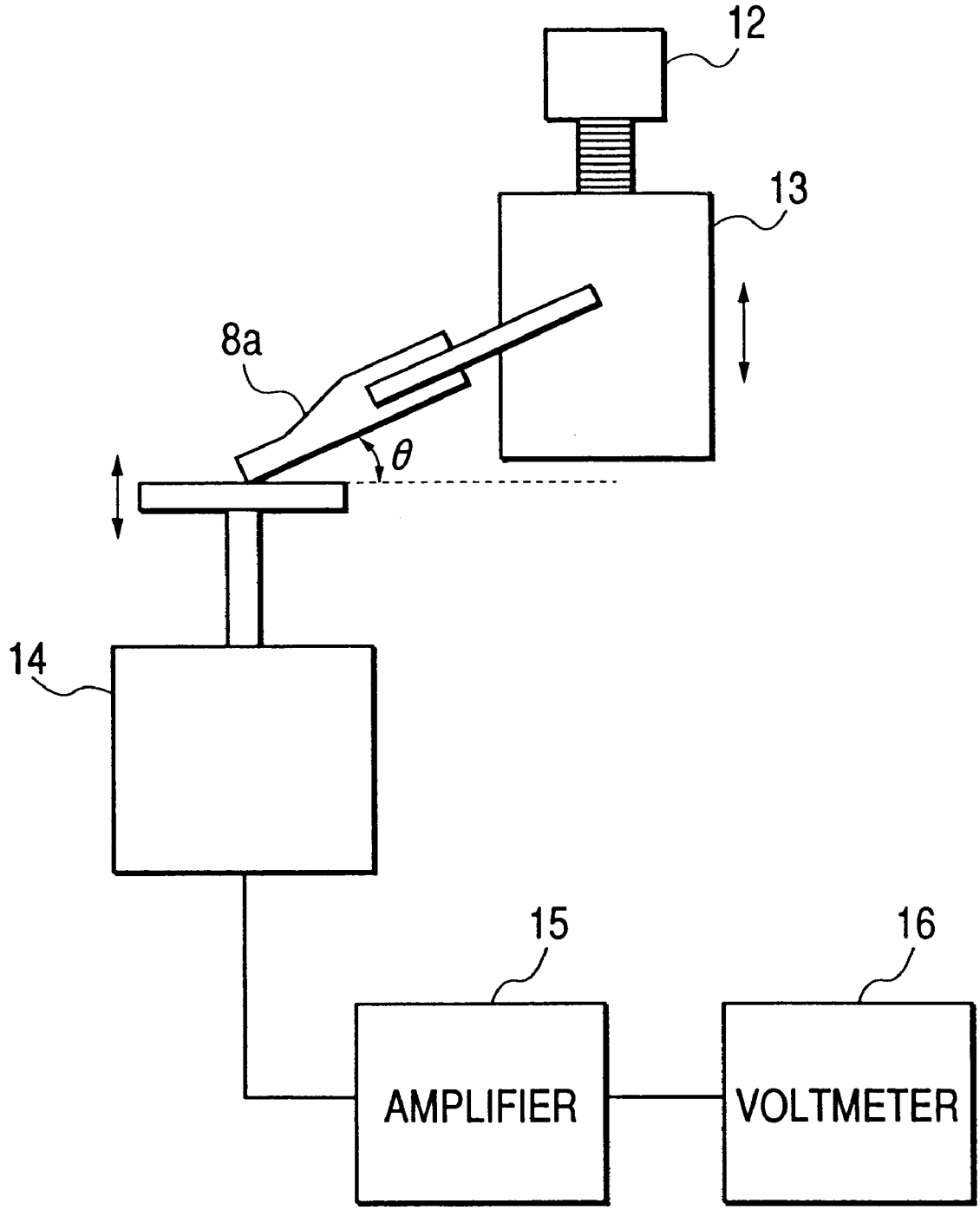
FIG. 7 is a diagram illustrating a measuring method of an abutment pressure of a cleaning blade.

Furthermore, referring to FIG. 7 to describe the measuring method of the abutment pressure in the above, the cleaning blade 8*a* cut so as to have a width of 1 cm is set first to a blade stand 13 movable in a direction indicated by an arrow in the diagram by a motor 12 and the cleaning blade is set at a desired preset angle (32° in this embodiment) so as to abut against a load sensor 14. Subsequently the blade stand 13 is moved in the direction of the load sensor 14 by the inroad amount δ required to be obtained, an output value of the load sensor 14 at that time is amplified by an amplifier 15, and then the value is read by a voltmeter 16. A previously obtained load per unit voltage is replaced with the linear load per unit length, and a value as a result of this is determined to be an abutment pressure.

Figure 8:
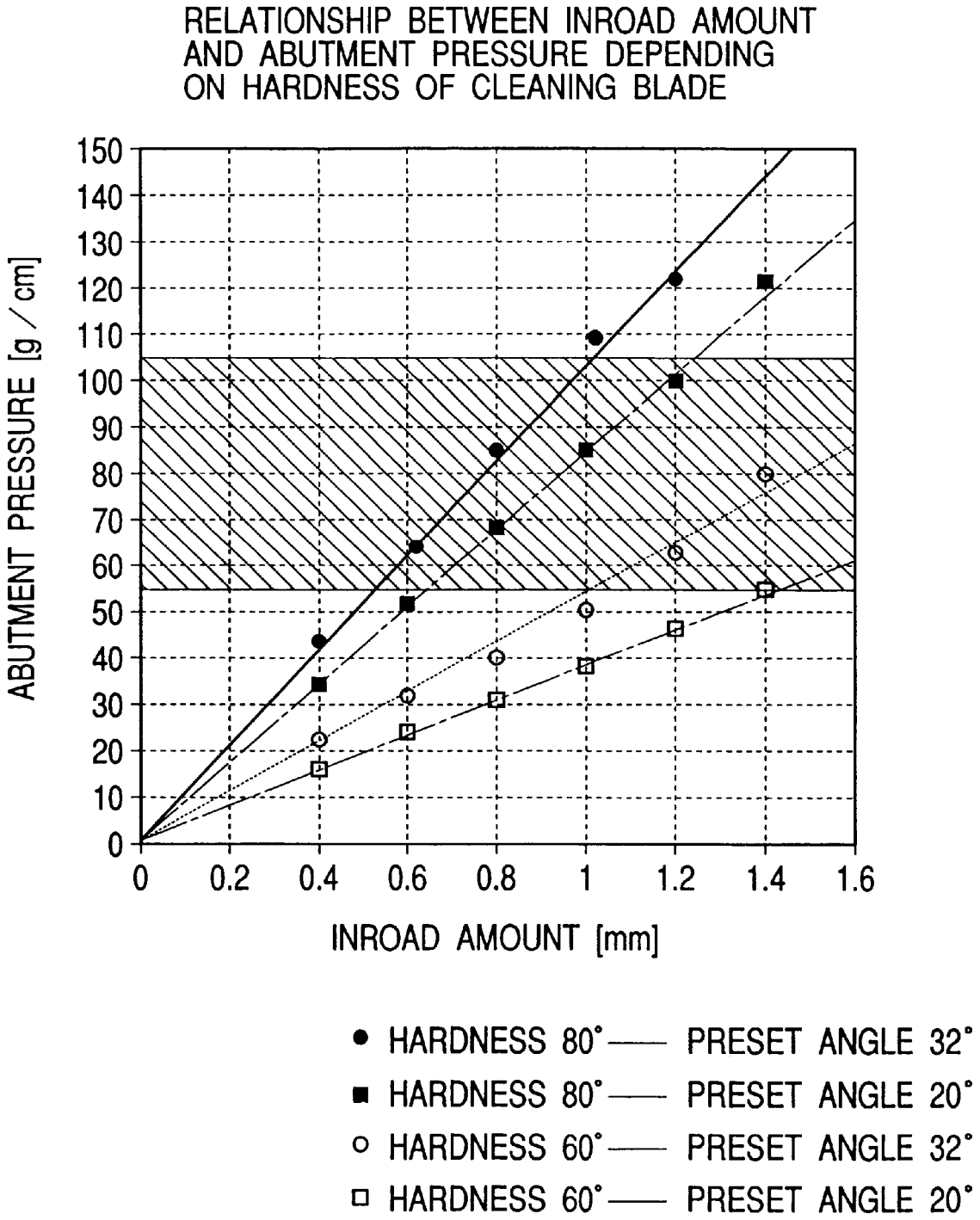
FIG. 8 is a graph for assistance of explaining a relationship between the abutment pressure and an inroad amount depending- on a hardness of the cleaning blade.

In the cleaning device of this embodiment, as shown in FIG. 8, a hardness of the cleaning blade 8*a* is selected so as to obtain an abutment pressure of 55 g/cm or greater within a range of an inroad amount less than 1.6 mm of the cleaning blade 8*a* toward the photosensitive drum 1 according to a relationship between the abutment pressure and the inroad amount depending on a hardness of the cleaning blade 8*a* obtained in the abutment pressure measuring method mentioned above.

The "tensile stress" described here is measured in a tensile stress measuring method by a dumbbell specimen specified by the JIS standard (K6301) and its value is obtained by a formula, $M_n=F_n/A$.

In the above formula, $M_n$, $F_n$, and A indicate a tensile stress kg/cm$^2$, a load [kgf] at specific elongation, and a sectional area [cm$^2$] of the specimen, respectively, and a value of $M_{300}$ (a tensile stress at 300% elongation) is treated in the present invention. In addition, the test described above is performed at 23° C.

With an application of an elastic blade having a high tensile stress, a greater force is required to deform the elastic blade in comparison with an elastic blade having a low tensile stress. Therefore, when an edge portion of the elastic blade is contacted with pressure to the surface of the rotating image bearing member, the edge portion of the elastic blade becomes hard to be deformed due to a friction with the surface of the image bearing member or an invasion of the toner or the like, by which the elastic blade is made to abut against the surface of the image bearing member always at a stable abutment pressure. Therefore, by using the above means, a gap becomes hard to be generated between the surface of the image bearing member and the elastic blade, by which substantially spherical toner and its outer additive are prevented from passing through the gap and therefore the cleaning property is improved. Furthermore, the toner and the outer additive are prevented from being fused together onto the image bearing member.

On the other hand, for a use in the cleaning blade 8*a* of the cleaning device in this embodiment, there are prepared a plurality of cleaning blades which indicate a 200 kg/cm$^2$ or greater value or break in a tensile test at 300% elongation, and the hardest blade among them has a hardness of 80° (JIS A).

If the hardness of the cleaning blade is increased to excess, it has become clear that the cleaning blade does not function as an elastic blade depending upon environmental conditions, for example, causing the cleaning blade 8*a* to lose a follow-up property to the photosensitive drum 1.

Accordingly, in the cleaning device of this embodiment, a cleaning blade having a hardness within a range of 60° or higher and 80° or lower (JIS A) is used as the cleaning blade 8*a*.

To check the effect of this embodiment, under three types of environments, 10° C./10% (under a low temperature and low humidity environment), 25° C./60% (under a normal temperature and normal humidity environment), and 35° C./90% (under a high temperature and high humidity environment), with fixing an inroad amount of the cleaning blade 8*a* to the photosensitive drum 1 to 1.3 mm and preparing cleaning blades 8*a* has different values in a tensile test ($M_{300}$) at 300% elongation as shown in Table 1, the cleaning blades are compared with each other on their endurance regarding cleaning properties and fusion bond levels.

TABLE 1

List of Solid State Properties of Cleaning Blade Test Samples [20° C.]

| | Hardness (JIS A) | Tensile Strength [kg/cm$^2$] | Elongation [%] | $M_{100}$ [kg/cm$^2$] | $M_{300}$ [kg/cm$^2$] |
|---|---|---|---|---|---|
| Sample 1 | 60 | 461 | 388 | 27 | 143 |
| Sample 2 | 68 | 456 | 382 | 29 | 148 |
| Sample 3 | 68 | 479 | 361 | 31 | 160 |
| Sample 4 | 65 | 389 | 342 | 26 | 172 |
| Sample 5 | 68 | 376 | 338 | 28 | 185 |
| Sample 6 | 69 | 358 | 335 | 30 | 194 |
| Sample 7 | 67 | 328 | 331 | 30 | 203 |
| Sample 8 | 72 | 298 | 330 | 31 | 221 |
| Sample 9 | 67 | 475 | 328 | 28 | 292 |
| Sample 10 | 68 | 310 | 262 | 31 | Break |
| Sample 11 | 74 | 321 | 231 | 36 | Break |
| Sample 12 | 80 | 316 | 218 | 35 | Break |

For the fusion bond level, an observation is made to determine whether or not there are any fusion bond substances on the photosensitive drum 1 and further an amount of blank areas on a solid image is observed since these fusion bond substances obstruct a normal image formation; the fusion bond level is judged in three ranks indicated by ○ for no blank area, Δ for some blank areas, and X for so many blank areas.

Table 2 shows an endurance test result of 7,000 pages (full-color printing in A4 size) performed by using an image forming apparatus of this embodiment. Particularly under the low temperature and low humidity environment, no cleaning failure occurred and a fusion bond level was favorable in an image forming apparatus including a cleaning blade 8*a* has a 170 kg/cm$^2$ or greater value or breaking in a tensile stress measurement at 300% elongation. On the contrary, the fusion bond level was deteriorated as the endurance test has progressed in an image forming apparatus including a cleaning blade 8*a* indicating a tensile stress value less than 170 kg/cm$^2$ at 300% elongation, and particularly a cleaning failure occurred in an image forming apparatus including a cleaning blade indicating a 150 kg/cm$^2$ or smaller value in a tensile stress measurement at 300% elongation.

TABLE 2

Endurance Test Result (1) Of Image Forming Apparatus According To Embodiment 1

| | Under Low Temperature And Low Humidity | | | Under Normal Temperature And Normal Humidity | | | Under High Temperature And High Humidity | | |
|---|---|---|---|---|---|---|---|---|---|
| | Cleaning Failure | Fusion Bond Substances On Photosensitive Drum | Fusion Bond Rank On Image | Cleaning Failure | Fusion Bond Substances On Photosensitive Drum | Fusion Bond Rank On Image | Cleaning Failue | Fusion Bond Substances On Photosensitive Drum | Fusion Bond Rank On Image |
| Sample 1 | NG | present | x | NG | Present (very small) | Δ | OK | Present | Δ |
| Sample 2 | NG | present | x | NG | Present (very small) | Δ | OK | Fresent | Δ |
| Sample 3 | OK | present | x | OK | Present (very small) | ○ | OK | Present (very small) | ○ |
| Sample 4 | OK | present (very small) | ○ | OK | Absent | ○ | OK | Absent | ○ |
| Sample 5 | OK | Present (very small) | ○ | OK | Absent | ○ | OK | Absent | ○ |
| Sample 6 | OK | Present (very small) | ○ | OK | Absent | ○ | OK | Absent | ○ |
| Sample 7 | OK | Absent | ○ | OK | Absent | ○ | OK | Absent | ○ |
| Sample 8 | OK | Absent | ○ | OK | Absent | ○ | OK | Absent | ○ |
| Sample 9 | OK | Absent | ○ | OK | Absent | ○ | OK | Absent | ○ |
| Sample 10 | OK | Absent | ○ | OK | Absent | ○ | OK | Present (very small) | ○ |
| Sample 11 | OK | Absent | ○ | OK | Absent | ○ | OK | Present (very small) | ○ |
| Sample 12 | OK | Absent | ○ | OK | Absent | ○ | OK | Present (very small) | ○ |

In addition, the same endurance test has been performed with setting an inroad amount so that the abutment pressure of the cleaning blade 8*a* against the photosensitive drum 1 is less than 50 kg/cm.

Table 3 shows the endurance test result, in which no cleaning failure occurred and the fusion bond level was favorable in an image forming apparatus including a cleaning blade 8*a* indicating a 200 kg/cm$^2$ or greater value or breaking in a tensile stress measurement at 300% elongation. On the contrary, a cleaning failure occurred in an image forming apparatus including a cleaning blade 8*a* has a value less than 200 kgf/cm$^2$ in a tensile stress measurement at 300% elongation, particularly under the low temperature and low humidity environment.

TABLE 3

Endurance Test Result (2) Of Image Forming Apparatus According To Embodiment 1

| | Under Low Temperature And Low Humidity | | | Under Normal Temperature And Normal Humidity | | | Under High Temperature And High Humidity | | |
|---|---|---|---|---|---|---|---|---|---|
| | Cleaning Failure | Fusion Bond Substances On Photosensitive Drum | Fusion Bond Rank ON Image | Cleaning Failure | Fusion Bond Substances On Photosensitive Drum | Fusion Bond Rank On Image | Cleaning Failure | Fusion Bond Substances On Photosensitive Drum | Fusion Bond Rank On Image |
| Sample 1 | NG | present | x | NG | Present | x | NG | Present | x |
| Sample 2 | NG | present | x | NG | Present | x | NG | Present | Δ |
| Sample 3 | NG | present | x | NG | Present | x | NG | Present (very small) | ○ |
| Sample 4 | NG | present | x | NG | Present (very small) | ○ | OK | Present (very small) | ○ |
| Sample 5 | NG | Present | Δ | OK | Present (very small) | ○ | OK | Present (very small) | ○ |
| Sample 6 | NG | Present (very small) | Δ | OK | Absent | ○ | OK | Absent | ○ |
| Sample 7 | OK | Present (very small) | ○ | OK | Absent | ○ | OK | Absent | ○ |
| Sample 8 | OK | Present (very small) | ○ | OK | Absent | ○ | OK | Absent | ○ |
| Sample 9 | OK | Absent | ○ | OK | Absent | ○ | ()K | Absent | ○ |
| Sample 10 | OK | Absent | ○ | OK | Absent | ○ | OK | Absent | ○ |
| Sample 11 | OK | Absent | ○ | OK | Absent | ○ | OK | Present (very small) | ○ |
| Sample 12 | OK | Absent | ○ | OK | Absent | ○ | OK | Present (very small) | ○ |

Judging from these results, it is found that it is preferable to use a cleaning blade which indicates a 200 kgf/cm$^2$ or greater value or breaks in a tensile stress measurement at 300% elongation as the cleaning blade 8*a* used for the cleaning device 8 in order to prevent a cleaning failure of developer having the shape coefficient SF1 of 100 to 150 under the low temperature and low humidity, normal temperature and normal humidity, and high temperature and high humidity environments and to prevent a fusion bond of the toner and the outer additive on the photosensitive drum 1.

Accordingly, in an image forming apparatus of this embodiment on which is mounted the cleaning device 8 including the cleaning blade 8*a* having the above properties, high-quality output images have been obtained without cleaning failures nor fusion bond for a long period even in use of developer having the shape coefficient SF1 of 100 to 150.

In addition, in the cleaning device, the elastic blade is made to abut against the surface of the image bearing member at the abutment pressure of a 55 kg/cm or greater linear load, by which is increased a latitude of a tensile stress at 300% elongation required for the cleaning blade 8*a* in cleaning developer having the shape coefficient SF1 of 100 to 150, and therefore, reliability of the cleaning device 8 is improved.

Second Embodiment

In an image forming apparatus of this embodiment, fluorine particles Teflon® each having a particle diameter of approximately 0.3 $\mu$m are dispersed by 10% in a charge transport layer 1*c* of a photosensitive drum 1 used for the image forming apparatus of the first embodiment of the present invention. The fluorine particles function as lubricating substances so as to improve the slip property of a surface of the photosensitive drum remarkably.

As a result of measuring a contact angle and a slip property to water of the surface of the photosensitive drum used in this embodiment, the contact angle is 100° and the slip property is 0.85. If the fluorine particles in the above is added to the surface mold releasing layer in excess, light passing through the charge transport layer Ic in exposure is scattered by the Teflon® particles, which obstructs a formation of a high-quality latent image. Therefore, preferably a dispersed amount of Teflon® in the charge transport layer Ic is up to approx. 20% as an upper limit.

To check the effect of this embodiment, under three types of environments, a low temperature and low humidity environment, a normal temperature and normal humidity environment, and a high temperature and high humidity environment in the same manner as for the first embodiment of the present invention, with fixing an inroad amount of the cleaning blade 8*a* to the photosensitive drum 1 to 1.3 mm and preparing cleaning blades 8*a* having different tensile stresses as shown in Table 1, the cleaning blades are compared with each other on their endurance regarding cleaning properties and fusion bond levels.

Table 4 shows an endurance test result of 7,000 pages (full-color printing in A4 size) performed by using an image forming apparatus of this embodiment. Particularly under the low temperature and low humidity environment, no cleaning failure occurred and a fusion bond level was favorable in an image forming apparatus including a cleaning blade 8*a* has a 170 kg/cm$^2$ or greater value or breaking in a tensile stress measurement at 300% elongation. On the contrary, the fusion bond level was deteriorated as the endurance test has progressed in an image forming apparatus including a cleaning blade 8*a* has a value less than 170 kg/cm$^2$ in an tensile stress measurement at 300% elongation, and particularly a cleaning failure occurred in an image forming apparatus including a cleaning blade has a 150 kg/cm$^2$ or smaller value in a tensile stress measurement at 300% elongation.

TABLE 4

Endurance Test Result Of Image Forming Apparatus According To Embodiment 2

| | Under Low Temperature And Low Humidity | | | Under Normal Temperature And Normal Humidity | | | Under High Temperature And High Humidity | | |
|---|---|---|---|---|---|---|---|---|---|
| | Cleaning Failure | Fusion Bond Substances On Photosensitive Drum | Fusion Bond Rank ON Image | Cleaning Failure | Fusion Bond Substances On Photosensitive Drum | Fusion Bond Rank On Image | Cleaning Failure | Fusion Bond Substances On Photosensitive Drum | Fusion Bond Rank On Image |
| Sample 1 | NG | present | x | NG | Present (very small) | Δ | OK | Present | Δ |
| Sample 2 | NG | present | x | NG | Present (very small) | ○ | OK | Present | Δ |
| Sample 3 | OK | present | x | OK | Absent | ○ | OK | Absent | ○ |
| Sample 4 | OK | present (Very Small) | ○ | OK | Absent | ○ | OK | Absent | ○ |
| Sample 5 | OK | Present (Very Small) | ○ | OK | Absent | ○ | OK | Absent | ○ |
| Sample 6 | OK | Absent | ○ | OK | Absent | ○ | OK | Absent | ○ |
| Sample 7 | OK | Absent | ○ | OK | Absent | ○ | OK | Absent | ○ |
| Sample 8 | OK | Absent | ○ | OK | Absent | ○ | OK | Absent | ○ |
| Sample 9 | OK | Absent | ○ | OK | Absent | ○ | OK | Absent | ○ |
| Sample 10 | OK | Absent | ○ | OK | Absent | ○ | OK | Absent | ○ |
| Sample 11 | OK | Absent | ○ | OK | Absent | ○ | OK | Absent | ○ |
| Sample 12 | OK | Absent | ○ | OK | Absent | ○ | OK | Absent | ○ |

In the image forming apparatus of this embodiment, also when using a photosensitive member in which fluorine particles are dispersed in its charge transport layer 1*c* as the photosensitive drum 1, it is found that a cleaning failure and a fusion bond of developer having the shape coefficient SF1 of 100 to 150 can be prevented by using a cleaning blade has a 200 kgf/cm$^2$ or greater value or breaking in a tensile stress measurement at 300% elongation as the cleaning blade 8*a* used for the cleaning device 8 and that high-quality output images can be obtained for a long period.

Third Embodiment

Figure 9:
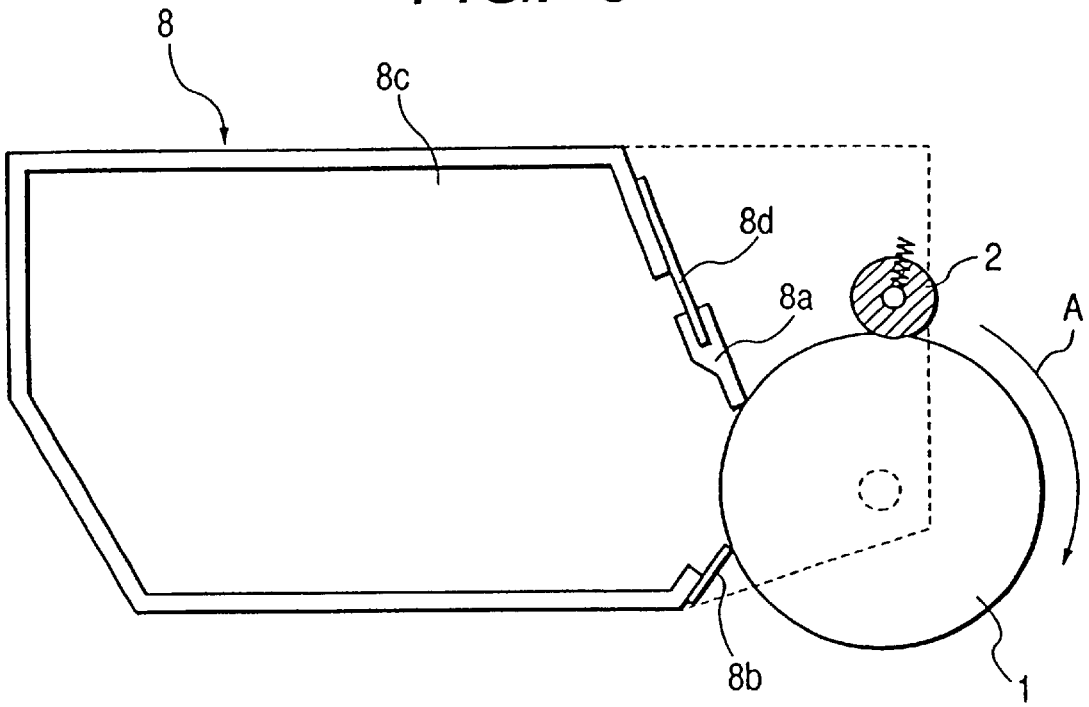
FIG. 9 is a schematic sectional view of a process cartridge according to a third embodiment of the present invention.
Figure 10:
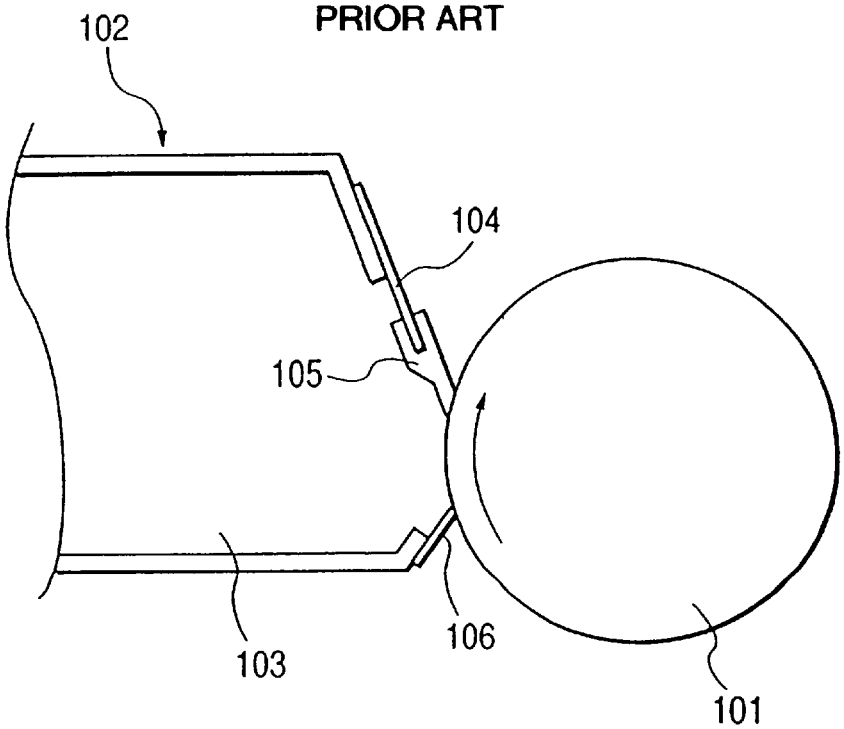
FIG. 10 PRIOR ART
FIG. 10 is a diagram for assistance in explaining a conventional blade cleaning method.

According to an image forming apparatus and a process cartridge of this embodiment, in the image forming apparatus of the first embodiment of the invention, a photosensitive drum 1, a charging roller 2 as charging means, and a cleaning device 8 are integrated so as to form a process cartridge as shown in FIG. 9, and the process cartridge is mounted on the image forming apparatus to perform an image forming operation.

In this embodiment, is used a cleaning blade which indicates a 200 kgf/cm$^2$ or greater value or breaks in a tensile stress measurement at 300% elongation as a cleaning blade 8*a* used for the cleaning device 8, by which it becomes possible to prevent a cleaning failure of developer having the shape coefficient SF1 of 100 to 150 under a low temperature and low humidity environment, a normal temperature and normal humidity environment, and a high temperature and high humidity environment so as to prevent fusion bond of toner and outer additive on the photosensitive drum 1, by which high-quality output images have been obtained without cleaning failures nor fusion bond for a long period.

In addition, with an application of a process cartridge method, it becomes possible to simplify procedures of replacing consumable components such as the photosensitive drum 1 with new ones or of treating waste toner collected in the waste toner collecting container 8*c*.

According to the present invention, it is possible to prevent a cleaning failure and fusion bond when using substantially spherical developer having the shape coefficient SF1 of 100 to 150 so as to obtain high-quality output images for a long period.

In an image forming apparatus having the above cleaning device, it is possible to prevent cleaning failures of substantially spherical toner and outer additive so as to suppress fusion bond of the toner and the outer additive on an image bearing member, by which high-quality output images are obtained for a long period.

In a process cartridge having the above cleaning device and detachably mountable to a main body of the apparatus, a favorable image is easily obtained at any time by replacing respective components of the integrated process cartridge with new ones according to a purpose at a device maintenance or when supplying consumable components.

Although an electrophotographic photosensitive member is exemplified as an object to be cleaned in the above embodiment, this invention is also applicable to a cleaning device for removing residual toner remaining on the intermediate transfer member 5 as shown in FIG. 1.

What is claimed is:

1. An electrophotographic image forming apparatus, comprising:

an electrophotographic photosensitive member which moves endlessly;

image forming means for forming an image on said photosensitive member by using toner having a shape coefficient SF1 of 100 to 150 and a shape coefficient SF2 of 100 to 140;

a transfer device for transferring the toner image, which has been formed on said photosensitive member onto a member to be transferred; and a cleaning device including:

an elastic blade, which has a 200 kg/cm$^2$ or greater value in tensile strength or breaks at 300% elongation, said elastic blade having a hardness (JIS A) of 60° to 80°; and a blade supporting member for causing said elastic blade to abut in a counter direction against said photosensitive member, which moves endlessly to rub and remove toner remaining on the photosensitive member after the transfer process, wherein said elastic blade abuts against a surface of said photosensitive member at an abutment pressure of a 55 gf/cm or greater without an inroad amount of said elastic blade into said photosensitive member exceeding 1.6 mm.

2. An electrophotographic image forming apparatus according to claim 1, wherein said elastic blade is made of polyurethane rubber.

3. An electrophotographic image forming apparatus according to claim 1, wherein toner of said apparatus is color toner and wherein said apparatus is a color image forming apparatus.

4. A process cartridge detachably mountable to a main body of an electrophotographic image forming apparatus, comprising:

an electrophotographic photosensitive member, which moves endlessly; and a cleaning device including:

an elastic blade, which has a 200 kg/cm$^2$ or greater value in tensile strength or breaks at 300% elongation, said elastic blade having a hardness (JIS A) of 60° to 80°; and a blade supporting member for causing said elastic blade to abut in a counter direction against said photosensitive member, which moves endlessly to rub and remove toner having a shape coefficient SF1 of 100 to 150 and a shape coefficient SF2 of 100 to 140 remaining on the photosensitive member after a transfer process, wherein said elastic blade abuts against a surface of said photosensitive member at an abutment pressure of a 55 gf/cm or greater without an inroad amount of said elastic blade into said photosensitive member exceeding 1.6 mm.

5. A process cartridge according to claim 4, wherein said elastic blade is made of polyurethane rubber.

6. A process cartridge according to claim 4, wherein said toner is color toner.

7. A cleaning method of cleaning a member used in an electrophotographic apparatus, said cleaning method comprising:

rubbing the member with an elastic blade to remove toner remaining on the member, said elastic blade having a 200 kg/cm$^2$ or greater value in tensile strength or being broken at 300% elongation, said elastic blade having a hardness (JIS A) of 60° to 80°, and said toner having a shape coefficient SF1 of 100 to 150 and a shape coefficient SF2 of 100 to 140, wherein said elastic blade abuts against a surface of the member at an abutment pressure of a 55 gf/cm or greater without an inroad amount of said elastic blade into said photosensitive member exceeding 1.6 mm.

8. An electrophotographic image forming apparatus according to claim 1, wherein said elastic blade is formed so that a thickness of a portion, supported by said blade supporting member, of said elastic blade is greater than a thickness of a free end of said elastic blade.

9. A process cartridge according to claim 4, wherein said elastic blade is formed so that a thickness of a portion, supported by said blade supporting member, of said elastic blade is greater than a thickness of a free end of said elastic blade.

* * * * *

UNITED STATES PATENT AND TRADEMARK OFFICE

CERTIFICATE OF CORRECTION

PATENT NO. : 6,405,015 B1
DATED : June 11, 2002
INVENTOR(S) : Jun Suzuki

It is certified that error appears in the above-identified patent and that said Letters Patent is hereby corrected as shown below:

Title page, Item [54] and Column 1, line 1,
"CLEANING MEMBER CLEANING DEVICE …" should read
-- CLEANING MEMBER, CLEANING DEVICE, … --.

Item [*] Notice, please insert -- This patent issued on a continued prosecution application filed under 37 CFR 1.53(d), and is subject to the twenty year patent term provisions of 35 U.S.C. 154(a)(2). --

Drawings,
Sheet 8, "[g/cm]" should read -- [g/cm$^2$] --.

Column 1,
Line 27, "what" should read -- in what --; and
Line 28, "in" should be deleted.

Column 2,
Line 20, "there" should read -- the --; and
Line 21, "occurs" should read -- there occurs --.

Column 3,
Line 11, "a" should read -- at --;
Line 43, "of" should read -- in --; and
Line 45, "depending-" should read -- depending --.

Column 5,
Line 40, "has" should read -- indicated --; and
Line 66, "has" should read -- that has --.

Column 6,
Line 15, "value" should read -- values --.

Column 7,
Line 20, "g/cm" should read -- g/cm$^2$ --; and
Line 61, "indicate" should read -- have --.

UNITED STATES PATENT AND TRADEMARK OFFICE

CERTIFICATE OF CORRECTION

PATENT NO. : 6,405,015 B1
DATED : June 11, 2002
INVENTOR(S) : Jun Suzuki

It is certified that error appears in the above-identified patent and that said Letters Patent is hereby corrected as shown below:

Column 8,
Line 16, “has” should read -- having --;
Line 47, “so” should be deleted; and
Line 56, “has” should read -- that has --.

Column 9,
Line 34, “kg/cm” should read -- $kg/cm^2$ --; and
Table 3, “Rank ON” should read -- Rank On --.

Column 11,
Line 16, “nor” should read -- or --.

Column 12,
Lines 24, 28 and 31, “has” should read -- that has --;
Table 4, “Rank ON” should read -- Rank On --; and
Line 66, “has” should read -- that have --.

Column 13,
Line 14, “is” should read -- there is --;
Line 15, “indicates” should read -- has --; and
Line 24, “nor” should read -- or --.

Signed and Sealed this

Eighth Day of July, 2003

JAMES E. ROGAN
*Director of the United States Patent and Trademark Office*